United States Patent [19]

Stangalini et al.

[11] Patent Number: 4,773,817

[45] Date of Patent: Sep. 27, 1988

[54] LABYRINTH SEAL ADJUSTMENT DEVICE FOR INCORPORATION IN A TURBOMACHINE

[75] Inventors: Gérard Stangalini, Fontainebleau; Philippe J. Lefebvre, Chennevieres sur Marne, both of France

[73] Assignee: Societe Nationale d'Etude et de Construction de Moteurs d'Aviation "S.N.E.C.M.A.", Paris, France

[21] Appl. No.: 89,543

[22] Filed: Aug. 26, 1987

[30] Foreign Application Priority Data

Sep. 3, 1986 [FR] France ..... 86 12358

[51] Int. Cl.[4] ..... F01D 11/00; F01D 17/14

[52] U.S. Cl. ..... 415/48; 415/127; 415/160; 415/171

[58] Field of Search ..... 415/47, 48, 126–128, 415/159, 160, 170 R, 171, 172 A, 174, 17; 277/53, 54

[56] References Cited

U.S. PATENT DOCUMENTS

| | | | |
|---|---|---|---|
| 2,972,441 | 11/1960 | Hall | 415/160 X |
| 3,019,035 | 1/1962 | Klompas | 277/54 X |
| 3,039,737 | 6/1962 | Kolthoff, Jr. | 415/48 X |
| 3,079,128 | 2/1963 | Burge | 415/160 X |
| 3,549,270 | 12/1970 | Petrie et al. | 415/172 A X |
| 3,558,237 | 1/1971 | Wall, Jr. | 415/172 A X |
| 3,623,736 | 11/1971 | Petrie et al. | 415/128 X |
| 3,850,544 | 11/1974 | Ciokajlo | 415/149 R |
| 4,127,357 | 11/1978 | Patterson | 415/170 R X |
| 4,135,362 | 1/1979 | Glenn | 415/160 X |
| 4,395,195 | 1/1983 | Cosmo | 415/137 |
| 4,604,030 | 8/1986 | Naudet | 415/160 X |

FOREIGN PATENT DOCUMENTS

| | | | |
|---|---|---|---|
| 0146449 | 3/1983 | European Pat. Off. . | |
| 306452 | 7/1957 | Switzerland . | |
| 350506 | 1/1961 | Switzerland . | |
| 299660 | 4/1971 | U.S.S.R. | 277/54 |
| 629770 | 2/1948 | United Kingdom . | |
| 1112058 | 9/1958 | United Kingdom . | |

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

The adjustment of clearances at the time of assembly and subsequently during operation of a labyrinth seal lying between the rotor and stator of a turbomachine is effected by radial displacements of a bush radially rigid with an outer pivot pin of each blade of the stator and co-operates with a boss of the casing by means of screw-threads. Such displacements are controlled as a function of a signal provided by a computer which integrates various operational parameters of the turbomachine and acts on a control ring connected by a lever to the said bush. The internal pivot of the blade is rigid with an annular member which carries a layer of abradable material constituting a fixed part of the labyrinth seal. The rotary part of the labyrinth seal is mounted on an opposed part of the rotor. A method for effecting the adjustment of the clearances is also described.

7 Claims, 1 Drawing Sheet

LABYRINTH SEAL ADJUSTMENT DEVICE FOR INCORPORATION IN A TURBOMACHINE

BACKGROUND OF THE INVENTION

1. Field of the Invention

The present invention relates to a turbomachine comprising a device for the adjustment of the clearances of a labyrinth seal which provides sealing between a rotor and a stator, the device also facilitating the alignment of the means defining the main gas flow of the engine. The invention also relates to a method for the application of the adjustment of the clearances of the seal.

2. Summary of the Prior Art

Research into high performance current turbomachines requires consideration of different aspects, amongst others, the efficiency and the production of maximum thrust. As a result the engines are always highly sensitive to the thermal conditions and also are particularly sensitive to the boundaries of the operational parameters leading to surging.

With a view to displacing the surging boundaries further from operational ratings and to reduce this sensitivity, particular attention must be applied to secondary phenomena arising during operaton of the machine: losses of fluid-tightness lead to the need for research into a perfect matching of the clearances during operation between the fixed and the rotary parts, recirculations which are always to be avoided, and defects in the alignment of the elements of the walls defining the main gas flow of the engine.

Such problems are encountered in particular at the roots of rotor blades and also, it is these problems which the invention seeks to overcome, between the inner diameter of one stage of the stator and the corresponding rotary part of the rotor, that is to say the region of the labyrinth seal in the zone where problems of non-alignment are also encountered in the main gas flow between the edges of the rotor blades and the stator elements constituting the inner wall of the gas flow defining passage.

As is conventional, the labyrinth seal used comprises two parts: annular lips, teeth or blades carried by a disc of the rotor and also a sealing ring. Such sealing ring is rigid radially with the inner side of the blades constituting one stage of the stator and supports a layer termed "abradable" capable of co-operating with the annular lips and of wearing on contact in order to ensure sealing under all operational conditions without risk of interference contact liable to give rise to damage.

Various devices have been used for adjusting the clearance between the sealing ring and the rotor, in response to the operational conditions of the engine. Thus, for example, U.S. Pat. No. 4,127,357 describes such a ring support device of a turbine in which the radial position of the segments constituting the ring is adjusted by means of a mechanism comprising a shaft support mounted eccentrically and driven in rotation by a toothed ring which is displaced independence upon variations of the operational parameters of the engine. This device applied to a fixed stator ring cannot however, be used for adjustment of the angular configuration in order to vary the angle of incidence of the blades, for example by means of a rotary pivot. The complexity of the device incorporating the use of an eccentric may give rise to disadvantages.

An object of the present invention is to overcome the disadvantages of previous proposals and to enable resolution of the problems referred to hereinbefore.

SUMMARY OF THE INVENTION

According to the present invention there is provided in a turbomachine, a stator stage comprising an array of stator blades, means defining an annular outline structure at the radially inner ends of the stator blades, a fixed annular part of a labyrinth seal mounted to and radially inwardly of said annular outline structure, a rotary part of the labyrinth seal, a casing surrounding the array of stator blades and having a plurality of screw-threaded bosses corresponding to the number of blades, each stator blade having a radially inner pivot pin pivotally mounted in said annular outline structure, and a radially outer pivot pin pivotally mounted in said casing, first means connecting the radially inner pivot pins and the annular outline structure, a plurality of bushes, each having a screw-threaded portion, corresponding in number to the number of blades, second means connecting each radially outer pivot pin and a respective bush, the screw-threaded portion of each bush being threadedly engaged with the screw-thread of the corresponding boss, and a control lever connected to each bush so that angular motion of the control lever results in relative motion of the bushes and the bosses and by means of the screw threads adjustment of the fixed part of the labyrinth seal relative to the rotary part of the labyrinth seal.

Preferably, the control lever is connected to a control and synchronization ring associated with a computer which integrates the various operational parameters of the turbomachine.

A method of adjustment in real time of the clearances of a labyrinth stator seal according to the invention comprises the following steps:

(a) Continuous acquisition of data relating to thermodynamic operational parameters of the turbomachine at the computer;

(b) Calculation of the temperature of the rotor mass and the stator mass;

(c) Calculation of the cumulative displacements of mechanical origin and thermal origin of the rotor and of the stator;

(d) Comparison of the resultant clearances and of the clearance desired;

(e) Calculation of the displacement of the control ring with respect to a position when cold, the basis of the value obtained by step (d);

(f) The output of a displacement signal of the control ring corresponding to the value obtained at (e);

(g) Repetition of steps (a) to (f) every second;

(h) In the case of failure of the computer at one of the preceding steps, substitution of a control signal for the displacement of the control ring into a predetermined fixed position.

BRIEF DESCRIPTION OF THE DRAWING

The sole FIGURE is a partial view in longitudinal section passing through the axis of rotation of a turbomachine comprising a device in accordance with the invention for adjusting the clearances of the labyrinth seal.

DESCRIPTION OF THE PREFERRED EMBODIMENT

Figure 1:
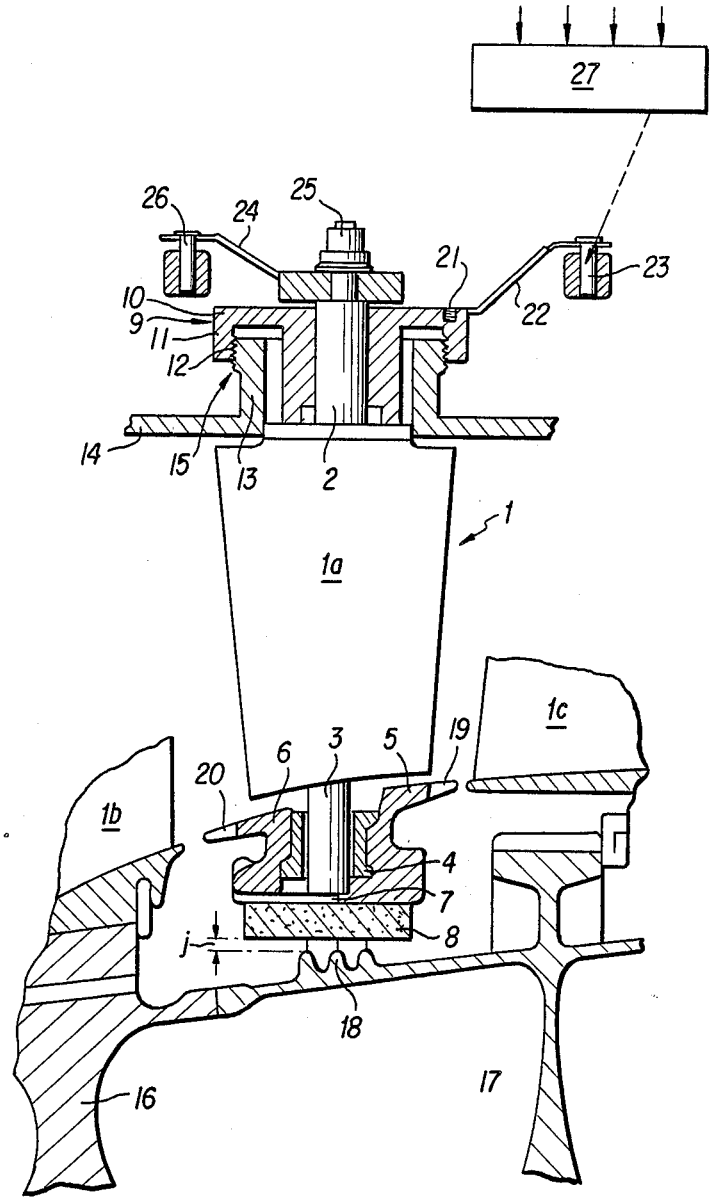

One stage of the stator 1 of the turbomachine is illustrated in the sole FIGURE. This is constituted by blades 1*a* of which the aerodynamic portion carries at each end, on the one hand a pivot pin 2 extending radially outwardly and on the other hand, a pivot pin 3 extending radially inwardly. The internal pivot pins of the blades are located through the intermediary of bushes 4 of the self-lubricating type engaged in semi-cylindrical castings forming two semi-rings 5 and 6, each taking the form of a segment. On the radially inner side, the semi-rings 5 and 6 are connected by a circular member 7 on which is disposed a layer 8 of a wear and sealing material, termed "an abradable". The circlip or any other equivalent means (not shown) radially connects each internal pivot pin 3 and the semi-rings 5 and 6.

The radially outer pivots of the blades are located in bushes 9 with which they are made rigid radially. Each bush 9 comprises at its radially outer end a circular plate 10 the periphery of which carries an annular flange 11 extending in the direction towards the shaft of the machine. The inner face of the annular flange 11 has a screw-thread 12. The bushes 9 are mounted in hollow cylindrical bosses 13 peripherally arranged, in the zone of the blades, radially outwardly of a casing 14. A screw-thread 12 of the bush 9 co-operates with a screw-thread 15 of the outer periphery of the boss 13.

The stator stage 1 is located between two rotor stages each comprising respectively rotor blades 1b and 1c carried by a respective disc 16 and 17. The disc 17 also supports the rotary part of the seal co-operating with the layer 8 of abradable material and is constituted by annular lips, annular teeth or annular blades 18. Each semi-ring 5 and 6 has a respectively lateral flange 19 and 20 at its radially outer edge. These flanges 19 and 20 co-operate with the egdes of the platforms of the corresponding rotor blades 1*b* and 1*c* so as to provide aerodynamic continuity of the inner wall of the gas flow defining passage of the engine.

The circular plates 10 of the bushes 9 each have a circular array of tapped holes 21 for securing the bush 9 to a control lever 22. The other end of each lever 22 is pivoted to a control and synchronization ring 23.

According to the embodiment illustrated in the sole FIGURE and in a manner known per se, a control device for adjusting the angular location of the blades 1*a* of the stator stage 1 can be added. In such case the outer end of the pivot pin 2, beyond the bush 9, comprises a screw-thread on which is mounted on end of a control lever 24 and a lock nut 25. The lever 24 is then connected to a control ring 26.

The device which has been described enables accurate control of the clearnace of the labyrinth seal when cold to a required value without being liable to various tolerances in the manufacture thus providing for an optimized setting.

In practice, during the assembly of the parts, before securing the control lever 22 in position on the bush 9 by simple rotation, a radial displacement is provided which enables adjustment of the clearnace j between the tips of the annular lips or blades 18 and the co-operating surface of the abradable layer 8 to the required value, in the zone of the labyrinth seal.

After having described one embodiment of the invention and its structure, the application to a stator of a turbomachine will now be described by way of example and the operation of the device in accordance with the invention corresponding to the method of adjustment in real time of the clearances of a stator labyrinth seal.

To the device which has just been described is added a computer 27 capable of evaluating an output signal which by means of a connection with the control ring 23 is able to effect any required displacement of the said ring.

At a given instant, the computer 27 is connected to various sensors which are moreover used for the control of the turbomachine during operation and placed in appropriate locations. The acquisition of data relating to thermodynamic operational parameters of the turbomachine is continuously effected and this data is, of course, representative of the thermal condition of the engine. These parameters include, in particular, the rating or speed of rotation, the temperature and pressure at various zones of the machine, in particular at the inlet and at the outlet of the compressor. As the function of pre-established programs, the computer 27 provides various calculations, in particular:

1. Calculation of the temperature of the rotor mass and of the stator mass under consideration;
2. Calculation of the radial displacements of the rotor and of the stator cumulatively with the displacements dependent upon their mechanical or thermal origin;
3. Comparison of the resultant clearance with the required clearance; and
4. Calculation of the displacement of the control ring 23 with respect to any position established when cold.

The output signal of the computer 27 is thus processed and acts upon the control ring 23 to displace ring 23. The computer 27 repeats the various operations described hereinbefore every second and there is thus obtained an adjustment in real time of the clearances of the stator seal and corresponding displacements of the inner ring of the stator 1 enabling provision at every instant of correct alignment of the internal walls of the elements of the means defining the main gas flow of the engine.

In the case of failure of the computer, a control is provided for an automatic adjustment of the clearance at the level or zone of the labyrinth seal to an acceptable value fixed in advance.

Obviously, numerous modifications and variations of the present invention are possible in light of the above teachings. It is therefore to be understood that within the scope of the appended claims, the invention may be practiced otherwise than as specifically described herein.

What is claimed is:

1. A turbomachine having a stator stage, comprising:

an array of stator blades, means defining an annular outline structure at the radially inner ends of the stator blades, a fixed annular part of a labyrinth seal mounted to an radially inwardly of said annular outline structure, a rotary part of the labyrinth seal, a casing surrounding the array of stator blades and having a plurality of screw-threaded bosses corresponding to the number of blades, each stator blade having a radially inner pivot pin pivotally mounted in said annular outline structure, and a radially outer pivot pin pivotally mounted in said casing, first means connecting the radially inner pivot pin and the annular outline structure, a plurality of bushes, each having a screwthreaded portion, corresponding in number to the number of blades, second means connecting each radially outer pivot pin and a respective bush said plurality of bushes, the screw-threaded portion of each bush being threadedly engaged with the screw-thread of the corresponding boss, and a control lever connected to each bush so that angular motion of the control lever results in relative motion of the bushes and the bosses and by means of the screw threads adjustment of the fixed part of the labyrinth seal relative to the rotary part of the labyrinth seal.

2. A turbomachine according to claim 1 comprising:

a ring connected to the control lever, said ring including means for control and synchronization of the radial location of the blades, and a computer which integrates the operation or parameters of the turbomachine in such a way that the displacements of the said control ring are controlled on the basis of a signal transmitted by said computer to the ring and hence to said control lever.

3. A turbomachine according to claim 1, wherein each said bush comprises:

a circular plate to which the control lever is secured, and a flange extending radially inwardly from said circular plate, the flange having internally thereof said screw-threaded portion, the latter co-acting with the screw-thread of the respective boss.

4. A turbomachine according to claim 1, wherein said annular outline structure has flanges extending respectively upstream and downstream in relation to the main gas flow, which flanges define the inner boundary of the gas flow, the precise boundary of the gas flow being produced by radial displacement of said flanges following radial displacement of each said bush.

5. a turbomachine according to claim 1, comprising an array of control levers, each lever of said array of control levers being connected to a respective pivot of each blade of the stator and further comprising an additional ring, said additional ring including means for adjusting the angular configuration of said array of control levers whereby to adjust the angle of incidence of the blades.

6. A method for adjustment of the clearances of a labyrinth stator seal comprising the following steps:

(a) continuous acquisition of data relating to thermodynamic operational parameters of the turbomachine at the computer;

(b) calculation of the temperature of the rotor mass and the stator mass;

(c) calculation of the cumulative displacements of mechanical origin and thermal origin of the rotor and of the stator;

(d) comparison of the resultant clearances and of the clearance desired;

(e) calculation of the displacement of the control ring with respect to a position when cold, the basis of the value obtained by step (d);

(f) outputting a displacement signal of the control ring corresponding to the value obtained at (e);

(g) repeating steps (a) to (f) every second; and (h) in the case of failure of the computer at one of the preceding steps, substitution of a control signal for the displacement of the control ring into a predetermined fixed position.

7. A method according to claim 6 wherein the thermodynamic parameters of step (a) comprise the rating of rotation, the temperature and the pressure at the inlet and outlet of the turbomachine compressor.

* * * * *

UNITED STATES PATENT AND TRADEMARK OFFICE

CERTIFICATE OF CORRECTION

PATENT NO. : 4,773,817

DATED : SEPTEMBER 27, 1988

INVENTOR(S) : GERARD STANGALINI ET AL

It is certified that error appears in the above-identified patent and that said Letters Patent is hereby corrected as shown below:

Column 1, line 26, delete "operaton" and substitute therefor --operation--;

line 61, delete "independence" and substitute therefor --in dependence--;

Column 3, line 39, delete "egdes" and substitute therefor --edges--;

line 52, after "mounted" delete "on" and substitute therefor --one--;

line 56, delete "clearnace" and substitute therefor --clearance--;

line 63, delete "clearnace" and substitute therefor --clearance--;

Column 4, line 58, after "mounted to" delete "an" and substitute therefor --and--;

Column 5, line 3, delete "screwthreaded" and substitute therefor --screw-threaded--;

line 7, after "respective bush" insert --of--;

UNITED STATES PATENT AND TRADEMARK OFFICE

CERTIFICATE OF CORRECTION

PATENT NO. : 4,773,817

DATED : SEPTEMBER 27, 1988

INVENTOR(S) : GERARD STANGALINI ET AL

It is certified that error appears in the above-identified patent and that said Letters Patent is hereby corrected as shown below:

Column 6, line 4, delete "a" and substitute therefor --A--.

Signed and Sealed this

Sixth Day of June, 1989

*Attest:*

*Attesting Officer*

DONALD J. QUIGG

*Commissioner of Patents and Trademarks*